US010427281B2

(12) United States Patent
Coffland

(10) Patent No.: US 10,427,281 B2
(45) Date of Patent: Oct. 1, 2019

(54) DYNAMIC OFF-AXIS TORQUE WRENCH COMPENSATION

(71) Applicant: The Boeing Company, Chicago, IL (US)

(72) Inventor: Donald Wayne Coffland, Seattle, WA (US)

(73) Assignee: The Boeing Company, Chicago, IL (US)

( * ) Notice: Subject to any disclaimer, the term of this patent is extended or adjusted under 35 U.S.C. 154(b) by 338 days.

(21) Appl. No.: 15/043,982

(22) Filed: Feb. 15, 2016

(65) Prior Publication Data

US 2017/0232593 A1 Aug. 17, 2017

(51) Int. Cl.
*B25B 23/142* (2006.01)
*B25B 23/00* (2006.01)

(52) U.S. Cl.
CPC ..... *B25B 23/1427* (2013.01); *B25B 23/0028* (2013.01)

(58) Field of Classification Search
CPC ..... B25B 23/1427; B25B 23/0028; B25B 13/461; B25B 23/142; A61C 1/186; A61B 17/8875
See application file for complete search history.

(56) References Cited

U.S. PATENT DOCUMENTS 2,362,149 A * 11/1944 Nelson ..... B25B 23/1427 81/483
3,964,351 A 6/1976 Ttsuji
4,732,062 A 3/1988 Grabovac et al.
5,911,801 A * 6/1999 Fravalo ..... B25B 23/1427 384/58
5,960,685 A * 10/1999 Shyong-Chuan ..... B25B 19/00 81/463
6,119,562 A 9/2000 Jenkins
(Continued)

FOREIGN PATENT DOCUMENTS

DE 91999 11/1954
DE 925458 3/1955
(Continued)

OTHER PUBLICATIONS

U.S. Appl. No. 14/600,509, filed Jan. 20, 2015, entitled "Torque-Wrench Apparatuses and Methods of Assembling the Same".

*Primary Examiner* — Robert J Scruggs
(74) *Attorney, Agent, or Firm* — Joseph F. Harding; The Small Patent Law Group LLC

(57) ABSTRACT

A torque wrench is provided that extends along a longitudinal axis and includes a head, a body, and a torque adjustment assembly. The head is shaped and adapted to engage at least one of a fastener or a torque-application adaptor aligned with a torque axis. The body includes a handle and a click-pivot assembly. The click-pivot assembly includes first and second members coupled by a link, and is configured to indicate application of a predetermined amount of torque via the handle. The head is pivotally coupled to the body via the torque adjustment assembly. A change in an angle between the torque axis and the longitudinal axis dynamically adjusts an amount of torque provided by the head by a predetermined amount relative to the predetermined amount of torque applied via the handle.

15 Claims, 14 Drawing Sheets

(56) References Cited

U.S. PATENT DOCUMENTS

| | | | | |
|---|---|---|---|---|
| 6,162,053 | A * | 12/2000 | Hollander | A61C 8/0089 433/141 |
| 8,806,993 | B2 | 8/2014 | Coffland | |
| 2002/0152849 | A1 * | 10/2002 | Jenkins | B25B 23/1425 81/479 |
| 2007/0295174 | A1 | 12/2007 | Hsieh | |
| 2009/0320653 | A1 * | 12/2009 | Coffland | B25B 23/1425 81/467 |
| 2011/0185862 | A1 * | 8/2011 | Coffland | B25B 23/1427 81/478 |
| 2011/0185863 | A1 | 8/2011 | Hsieh | |

FOREIGN PATENT DOCUMENTS

| | | |
|---|---|---|
| FR | 1028544 | 5/1953 |
| FR | 1034602 | 7/1953 |
| FR | 2584330 | 1/1987 |
| WO | 02070208 | 12/2002 |

* cited by examiner

DYNAMIC OFF-AXIS TORQUE WRENCH COMPENSATION

FIELD OF EMBODIMENTS OF THE DISCLOSURE

Embodiments of the present disclosure generally relate to torque wrenches, for example to torque wrenches providing for dynamic compensation for off-axis use.

BACKGROUND OF THE DISCLOSURE

Torque wrenches may be used for accurate application of torque to fasteners. However, fasteners may be located in confined spaces, requiring the use of a torque wrench in a position at which the handle of the torque wrench is not perpendicular to the fastener (to which the torque is applied). Extensions and adaptors may be used in such circumstances. However, when using extensions or adaptors with torque wrenches, correction factors may be required to ensure that a proper torque is being delivered to the fastener. Correction factors are related to the geometry of the extensions or adaptors and must be computed for each operation requiring a different extension or adaptor and/or a different torque, and such computations are time consuming and may be subject to error.

SUMMARY OF THE DISCLOSURE

Accordingly, apparatuses and methods, intended to address the above-identified concerns, would find utility.

Certain embodiments of the present disclosure provide a torque wrench that extends along a longitudinal axis and includes a head, a body, and a torque adjustment assembly. The head is shaped and adapted to engage at least one of a fastener or a torque-application adaptor aligned with a torque axis. The body includes a handle and a click-pivot assembly. The click-pivot assembly includes first and second members that are coupled by a link, and is configured to indicate application of a predetermined amount of torque via the handle. The head is pivotally coupled to the body via the torque adjustment assembly. A change in an angle between the torque axis and the longitudinal axis dynamically adjusts an amount of torque provided by the head by a predetermined amount relative to the predetermined amount of torque applied via the handle.

Certain embodiments of the present disclosure provide a torque wrench that extends along a longitudinal axis and includes a head, a body, and a torque adjustment assembly. The head is shaped and adapted to engage at least one of a fastener or a torque-application adaptor aligned with a torque axis. The body includes a handle and a click-pivot assembly. The click-pivot assembly includes a spring and first and second members. The first member and the second member are coupled by a link, with the second member interposed between the spring and the first member. The spring is configured to bias the second member toward the first member, wherein a force applied by the spring determines a predetermined amount of torque applied by the handle indicated by the click-pivot assembly. The head is pivotally coupled to the body via the torque adjustment assembly. The torque adjustment assembly is configured such that an increase in a deviation from a perpendicular orientation between the torque axis and the longitudinal axis compresses the spring to dynamically adjust an amount of torque provided by the head by a predetermined amount relative to the predetermined amount of torque applied via the handle.

Certain embodiments of the present disclosure provide a method (e.g., a method for providing a torque wrench). The torque wrench defines a longitudinal axis. The method includes providing a head shaped and adapted to engage at least one of a fastener or a torque-application adaptor aligned with a torque axis. Also, the method includes providing a body comprising a handle and a click-pivot assembly. The click-pivot assembly includes first and second members coupled by a link, and is configured to indicate application of a predetermined amount of torque via the handle. Further, the method includes coupling the head to the body via a torque adjustment assembly. The head is pivotally coupled to the body via the torque adjustment assembly, and a change in an angle between the torque axis and the longitudinal axis dynamically adjusts an amount of torque provided by the head by a predetermined amount relative to the predetermined amount of torque applied via the handle.

Certain embodiments of the present disclosure provide a method (e.g., a method for using a torque wrench). The torque wrench defines a longitudinal axis. The method includes positioning a head to engage at least one of a fastener or a torque-application adaptor aligned with a torque axis. The method also includes pivoting the head with respect to the longitudinal axis. Further, the method includes adjusting, as the head pivots, with a torque adjustment assembly that couples the head to a body of the torque wrench, an amount of torque provided by the head by a predetermined amount relative to an amount of torque indicated by a click-pivot assembly of the torque wrench. A change in an angle between the torque axis and the longitudinal axis dynamically adjusts the amount of torque provided by the head. Also, the method includes applying a force to the body of the torque wrench to apply a torque to the at least one of the fastener or the torque-application adaptor.

Certain embodiments of the present disclosure provide a torque wrench extending along a longitudinal axis, the torque wrench includes a head and a body. The head is shaped and adapted to engage at least one of a fastener or a torque-application adaptor aligned with a torque axis. The body includes a handle, and also includes torque-indication means for indicating application of a predetermined amount of torque via the handle. (It may be noted that the torque indication means may include a click-pivot assembly such as a click-pivot assembly as discussed herein, or as another example, may include a sensor coupled to a display or readout.) The torque wrench also includes torque adjustment means for dynamically adjusting an amount of torque provided by the head by a predetermined amount relative to the predetermined amount of torque applied via the handle. (It may be noted that the torque adjustment means may include a linkage or assembly including one or more aspects of one or more torque adjustment assemblies as discussed herein.) The head is pivotally coupled to the body via at least a portion of the torque adjustment means.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide systems and methods for compensating or adjusting for off-axis use of a torque wrench. As used herein, an off-axis use may be understood as a use of a torque wrench to apply a torque to a target that is not oriented perpendicularly to the longitudinal axis of the torque wrench, for example to tighten a fastener defining a torque axis that is not perpendicular to the longitudinal axis of the torque wrench. For example, a torque-wrench may be configured to provide a predetermined amount of torque to a fastener oriented at a right angle to the torque-wrench, or an axis defined by a handle of the torque wrench. However, if the torque wrench is used in an off-axis application in which the fastener is not oriented at or near a right angle with the handle of the torque wrench, the predetermined amount of torque indicated by the torque wrench will differ from the actual amount of torque actually applied to the head. Various embodiments provide for dynamic compensation of torque applied to a head of a torque wrench as the head pivots to engage a fastener (or other target object) that is not oriented at 90 degrees to the torque wrench handle.

Figure 1:
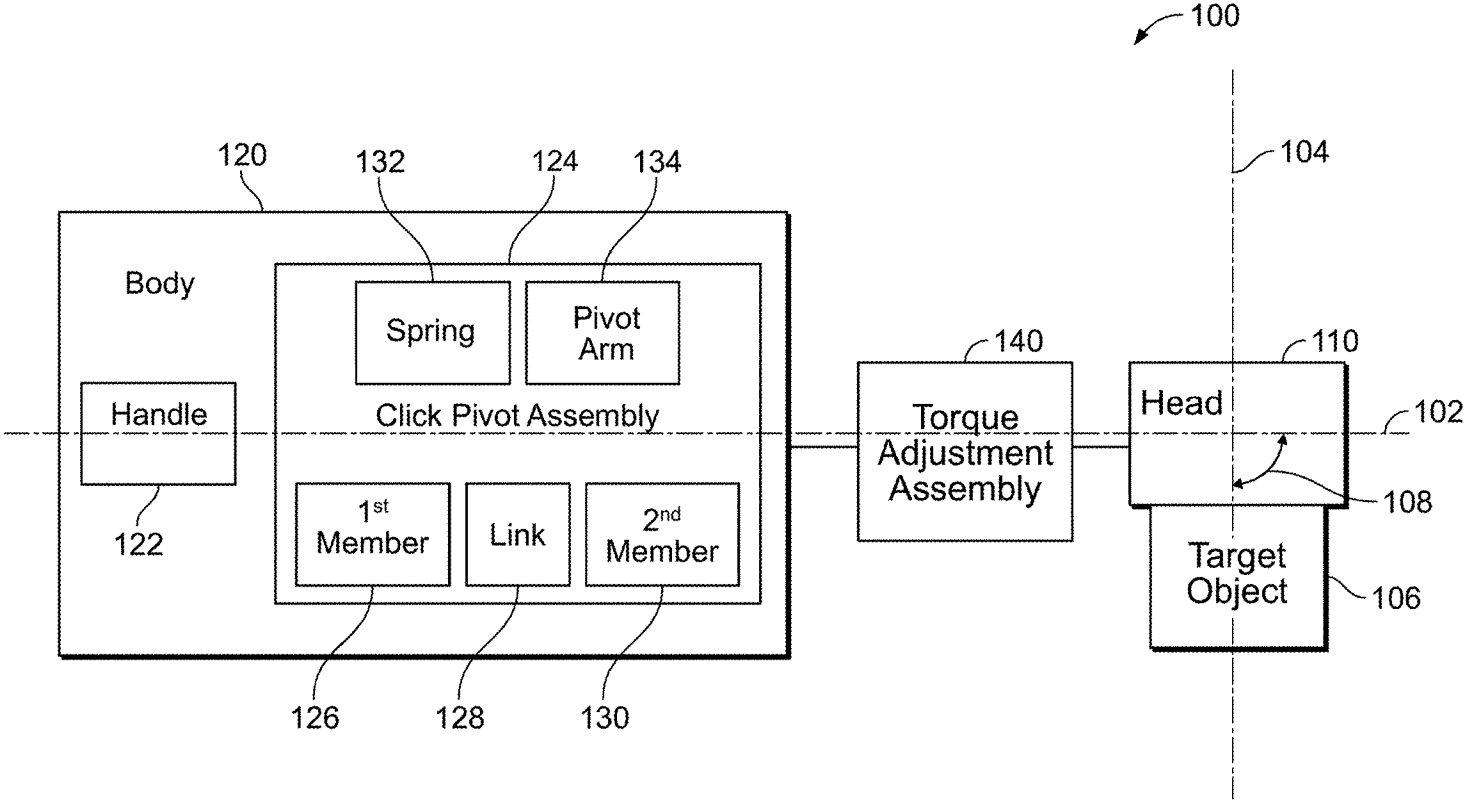
FIG. 1 provides a schematic view of a torque wrench in accordance with various embodiments.

FIG. 1 provides a schematic view of a torque wrench 100 in accordance with various embodiments. As seen in FIG. 1, the torque wrench 100 generally extends along a longitudinal axis 102, and includes a head 110, a body 120, and a torque adjustment assembly 140. Generally, the head 110 is used to apply torque to a target object 106 (e.g., a fastener or torque-application adaptor such as a socket). The body 120 is used, for example, by an operator, to receive an external force (e.g., provided by the hand of the operator) to provide a torque to be applied to the target object 106 via the head 110. The torque adjustment assembly 140 couples the head 110 to the body 120, and is configured to vary the amount of torque provided by the head 110 relative to a predetermined torque or force provided by the body 120. For example, as the head 110 pivots with respect to the body 120, the amount of torque provided by the head 110 before a click-pivot mechanism indicates achievement of a predetermined torque may vary by a predetermined amount. In various embodiments, the geometry of one or more linkages or assemblies of the torque adjustment assembly 140 may vary a pivot arm and/or application point of a force transmitted between the body 120 and the head 110 as the head 110 pivots with respect to the body 120 to provide a consistent amount of torque to the head 110 (e.g., used to tighten a fastener) before the click-pivot mechanism indicates achievement of the predetermined torque.

The depicted head 110 is shaped and adapted to engage the target object 106 (e.g., a fastener or torque-application adaptor such as a socket). The target object 106 is aligned with a torque axis 104. For example, for a fastener aligned with the torque axis 104, the fastener is articulated (e.g., tightened or loosened) along the torque axis 104 as a torque is applied to the fastener about the torque axis 104. The head 110 may define a plane (e.g., a plane extending through a central portion of the head 110), with the head 110 and plane defined by the head oriented normal to the torque axis 104.

The body 120 illustrated in FIG. 1 includes a handle 122 and a click-pivot assembly 124. The handle 122 is configured to receive an external force for applying a torque to the target object 106. For example, an operator may grasp the handle 122 and urge the handle in a direction to rotate the target object 106 clockwise (e.g., to tighten a fastener). The handle 122 may be generally cylindrical in shape. The click-pivot assembly 124 may be disposed within the body 120 and generally configured to provide an indication (e.g., an audible and/or tactile click) when a predetermined amount of torque is applied to the head 110. The predetermined amount of torque may be varied, for example by increasing or decreasing the compression of a spring of the click-pivot assembly 124.

In the embodiment illustrated in FIG. 1, the click-pivot assembly 124 includes a first member 126, a second member 128, and a link 130. The first member 126 and the second member 128 are joined by the link 130. The click-pivot assembly 124 is configured to indicate application of a predetermined amount of torque via the handle 122 to the head 110. For example, when the predetermined amount of torque is reached, the link 130 may act as a toggle, with the first member 126 and second member 128 articulating with respect to the link 130 to provide an audible and/or tactile click to an operator using the torque wrench 100.

In various embodiments, the click-pivot assembly 124 includes a spring 132. The spring 132 is disposed within the body 110. The spring 132, for example, may be disposed at a rearward portion (e.g., away from the head 110) of the body 120, and biases the second member 128 of the click-pivot assembly 124 toward the first member 126 of the click-pivot assembly 124. The predetermined amount of torque (the torque applied before a click is provided by the click-pivot assembly 124) applied is determined by a force applied by the spring 132. In some embodiments, the torque adjustment assembly 140 may vary a compression of the spring 132 responsive to a pivoting of the head 110 relative to the body 120.

Figure 2:
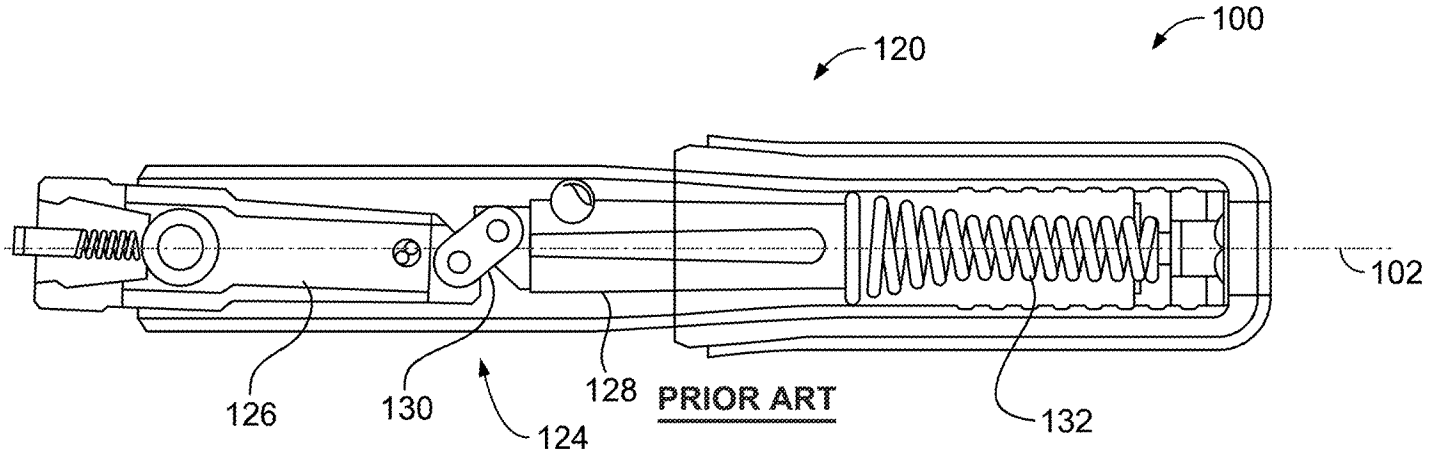
PRIOR ART FIG. 2
FIG. 2 provides a view of a torque wrench including an internal click-pivot mechanism.
Figure 3:
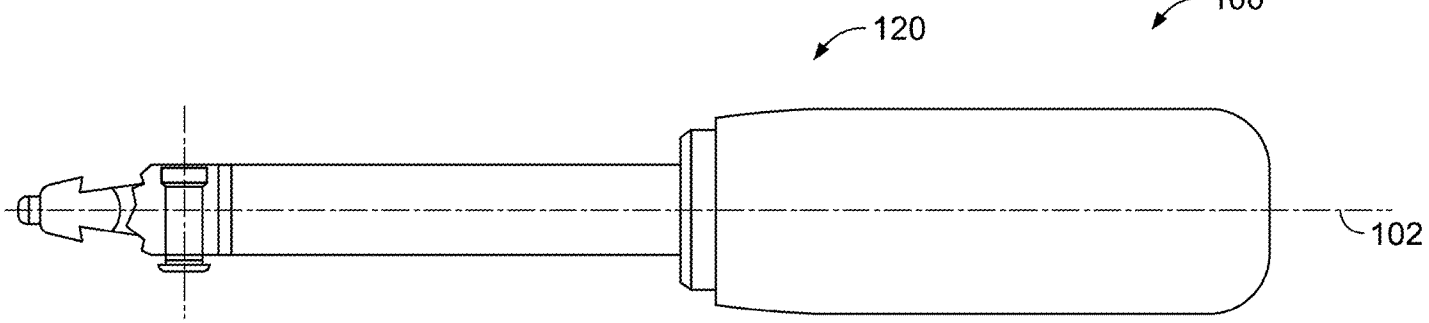
PRIOR ART FIG. 3
FIG. 3 provides an additional view of a torque wrench including an internal click-pivot mechanism.

It may be noted that the click-pivot assembly 124 may be an internal mechanism of the torque wrench 100 that limits or sets the amount of force that may be transferred to the head 110). In various examples, the limit or setting may be indicated by a "click" that may be audibly and/or tactilely observable by an operator. Click-type torque wrench mechanisms as known in the art may be utilized in various examples to set or limit an amount of force transferred from the handle 122. (See, e.g., FIGS. 2-3 for an example of a click-type torque wrench.)

Returning to FIG. 1, the depicted torque adjustment assembly 140 is configured to compensate for off-axis use of the torque wrench 100 (e.g., application of torque to a target object not aligned perpendicularly to the longitudinal axis 102) without requiring an external adjustment by an operator of a torque indication system or assembly such as the click-pivot assembly 124. The torque adjustment assembly 140, for example, may autonomously compensate without operator involvement or intervention for off-axis use based on a pivoting of the head 110 with respect to the body 120. For example, the head 110 may be pivoted to align with the target object (e.g., a plane defined by the head 110 oriented normal to the torque axis 104), and the torque adjustment assembly 140 dynamically compensates the amount of torque applied by the head 110 relative to the predetermined amount of torque applied via the click-pivot mechanism 124 as the head 110 rotates. In the depicted embodiment, the torque adjustment assembly 140 is configured (e.g., the components of the torque adjustment assembly are sized and assembled in a predetermined configuration) so that a change in an angle 108 between the torque axis 104 and the longitudinal axis 102 dynamically adjusts, by a predetermined amount or proportion relative to the change in angle, an amount of torque provided by the head 110 (e.g., to the target object 106) relative to the predetermined amount of torque indicated by click-pivot assembly 124 for a force applied via the handle 122.

The torque wrench 100 extends along the longitudinal axis 102. The torque wrench 100 may be understood as extending generally along the longitudinal axis 102, for example as one or more aspects of the torque wrench 100, such as the head 110, may be pivoted or articulated to a position not aligned with the longitudinal axis 102. As the head 110 is pivoted out of alignment with the longitudinal axis 102, or, put another way, as the torque axis 104 increasingly diverges from a perpendicular orientation with respect to the longitudinal axis 102, the amount of torque provided to the head 110 at the point the click-pivot assembly 124 clicks or otherwise indicates achievement of a predetermined amount of torque would decrease (as a portion of the force applied at the handle would tend to bend a fastener instead of turn the fastener), if not addressed or compensated for. Accordingly, various embodiments compensate for the potential decrease in torque provided to the target object 106. In various embodiments, the torque adjustment assembly 100 is configured to increase the amount of torque provided by the head 110 relative to the predetermined amount applied via the handle 110 as the angle 108 between the torque axis 104 and the longitudinal axis 102 increasingly diverges from perpendicular. The particular sizes, orientations, and positions of the components of the torque adjustment assembly 100 may be selected to provide a consistent torque to the head 110 relative to the predetermined amount of torque applied by the torque wrench 100 as the head 110 pivots with respect to the body 120. In some embodiments, an off-axis angle is compensated for by forcing a mechanic or operator to pull progressively harder as the angle increases on a wrench handle before a click mechanism is activated. In some embodiments, the same pulling force by an operator may activate the click mechanism at different angles; however, the wrench may be lengthened as the angle increases to compensate for the off-axis use.

For example, in some embodiments, a compression of a spring (e.g., spring 132) may be varied based upon a pivoting of the head 110 relative to the body 120. For example, the spring 132 may be compressed to provide a greater force urging the second member 128 toward the first member 124 as the head 110 pivots out of alignment with the body 120 (or as the torque axis 104 increasingly diverges from a perpendicular alignment with the longitudinal axis 102). As another example, in some embodiments, the torque adjustment assembly 140 may define a pivot arm 134 transferring a force from the head 110 to the body 120. The pivot arm 134, for example, may be defined by a point of contact at which the force is transferred from the head 110 to the body 120. The torque adjustment assembly 140 may be configured such that a length of the pivot arm 134 may vary relative to the pivoting of the head 110 relative to the body 120. As one more example, the torque adjustment assembly 140 may be configured to vary a distance of the torque axis 104 from the body 120 when the head 110 pivots relative to the body 120. For instance, the head 110 and torque axis 104 may be extended farther away from the body 120 as the head 110 pivots out of alignment with the body 120 (or as the torque axis 104 increasingly diverges from a perpendicular alignment with the longitudinal axis 102).

Figure 4:
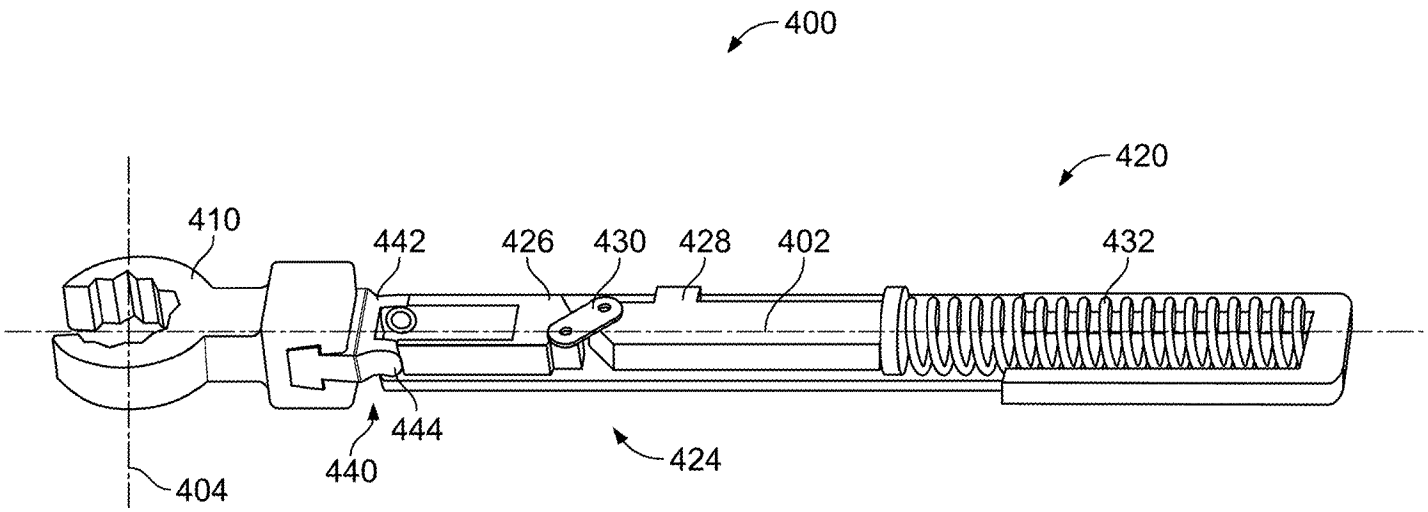
FIG. 4 depicts a perspective sectional view of a torque wrench in accordance with various embodiments.
Figure 5:
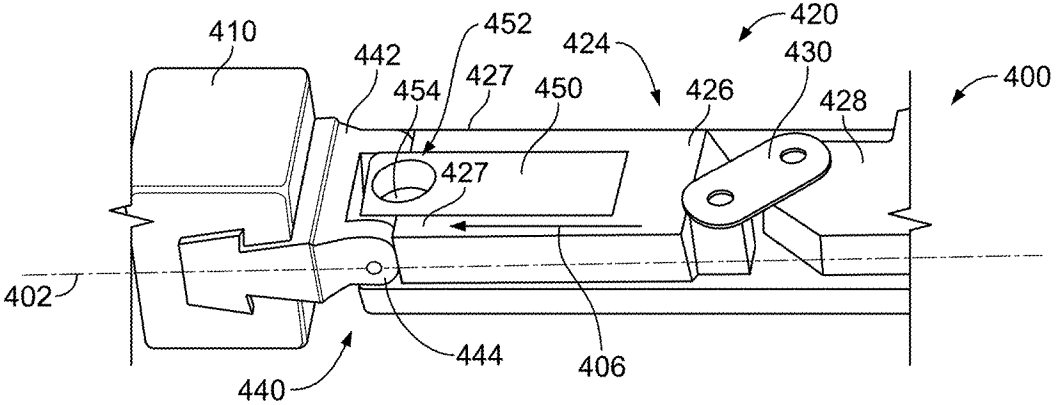
FIG. 5 illustrates an enlarged view of the torque wrench of FIG. 4.

In various embodiments, the torque wrench 100 may include a torque adjustment assembly 140 that is configured to articulate at least a portion of the click-pivot assembly 124 disposed within the body 120 along the longitudinal axis 132 responsive to a pivoting of the head 110 with respect to the body 120. For example, FIG. 4 provides a perspective sectional view of a torque wrench 400. FIG. 5 provides a blown-up sectional view of a portion of the torque wrench 400 with the head aligned with the body, and FIG. 6 provides a blown-up sectional view of a portion of the torque wrench 400 with the head not aligned with the body.

Figure 6:
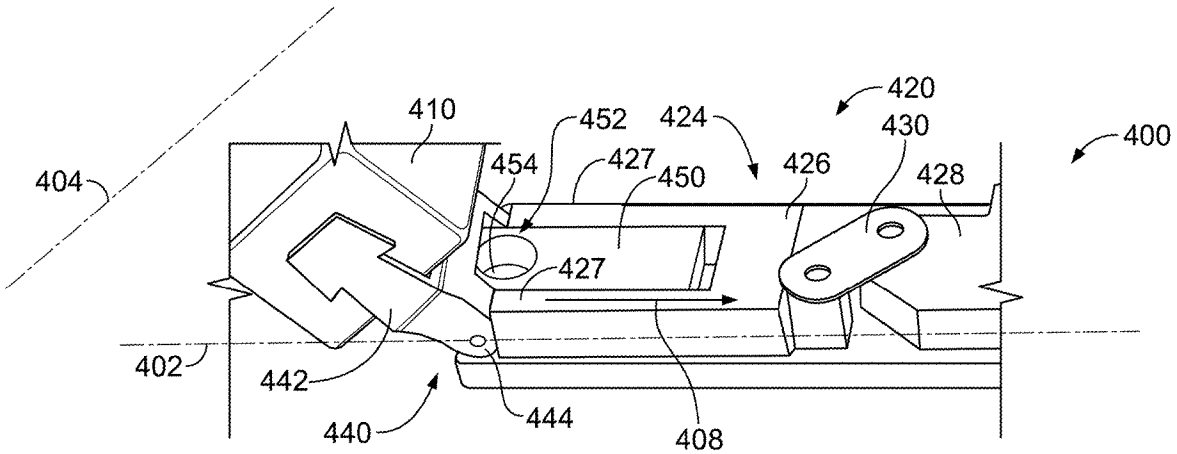
FIG. 6 illustrates an enlarged view of the torque wrench of FIG. 4.

As seen in FIGS. 4-6, the depicted torque wrench 400 is generally aligned along a longitudinal axis 402 and includes a head 410, a body 420, and a torque adjustment assembly 440. Generally, for the embodiment depicted in FIGS. 4-6, a cam is utilized against a click mechanism spring, with the cam compressing the spring 432 more as an off-axis angle (or angle between the longitudinal axis and the torque axis) increases. Accordingly, a mechanic or operator must apply more force at the handle to activate the click mechanism as the off-axis increases. The head 410 is configured to grasp and apply torque to a fastener (not shown in FIGS. 4-6) aligned with a torque axis 404. The body 420 includes a click-pivot assembly 424 disposed within the body 420. The click-pivot assembly 424 includes a first member 426, a second member 428, a link 430, and a spring 432. The first member 426 and the second member 428 are coupled by the link 430. The second member 428 is interposed between the spring 432 and the first member 426, with the spring 432 configured to bias the second member 428 toward the first member 426. A force applied by the spring 432 determines a predetermined amount of torque applied by a handle 422 of the body 420 indicated by the click-pivot assembly 424. For example, as the spring 432 is compressed, the force exerted by the spring 432 on the second member 428 increases, thereby increasing the amount of torque provided before the click-pivot mechanism 424 provides a click. For example, if a first fastener is to be torqued to a first value, the spring is adjusted to a first corresponding compressed position. If a second fastener is to be torqued to a second value, the spring is again adjusted to a second corresponding compressed position.

Increasing the amount of torque using a torque adjustment assembly as discussed herein may be understood as increasing the torque applied by the torque wrench that may be used to turn a target such as a fastener relative to the torque that would be provided for turning the fastener without a torque adjustment assembly (e.g., by a conventional torque wrench). For example, for off-axis applications, the torque transmitted from the handle of the torque wrench is split into forces that both torque the fastener and apply a bending force to the fastener, resulting in a conventional torque wrench indicating that a desired torque has been reached before that amount of torque has actually been applied to the fastener, as some of the force has been diverted as a bending force instead. By increasing the amount of torque applied by the torque wrench relative to that provided by a conventional torque wrench in such a situation, the actual torque applied for turning the fastener may be maintained at or near a constant level over a range of off-axis applications (e.g., a range of angles between the longitudinal axis and the torque axis).

The head 410 is pivotally coupled to the body 420 via the torque adjustment assembly 440. The torque adjustment assembly 440 is configured such that an increase in a deviation from a perpendicular orientation between the torque axis 404 and the longitudinal axis 420 compresses the spring 432 to dynamically adjust an amount of torque provided by the head 410 by a predetermined amount relative to the predetermined amount of torque applied via the handle 422 and indicated by the click-pivot assembly 424. The predetermined amount by which the torque is varied may be determined, for example, based on the geometry and/or other properties of one or more components of the torque adjustment assembly 440 and/or the click-pivot mechanism 424. For example, the amount of change of radius of a lobe of a cam of the torque adjustment assembly 440 as well as properties of the spring 432 (e.g., spring constant, spring length) may determine how much the amount of torque provided varies based on a pivoting of the head 410 with respect to the body 440.

In the embodiment depicted in FIGS. 4-6, the torque adjustment assembly 440 includes a head adaptor 442 that includes a cam 444. The cam 444 is coupled to the first member 426 of the click-pivot assembly 424. In the illustrated embodiment, the spring 432 provides a force that urges the first member 426 against the cam 444. The cam 444 is configured to articulate the first member 426 along the longitudinal axis 402 when the head 410 pivots relative to the body 420. For example, a radius of the lobe of the cam 444 may vary as the cam 444 rotates with the head 410 with respect to the body 420. As the lobe radius increases, the first member 426, link 430, and second member 428 are urged along direction 408 (see FIG. 6) to compress the spring 432. As the lobe radius decreases, the spring 432 urges the second member 428, link 430, and first member 426 along direction 406 (see FIG. 5), reducing compression in the spring 432.

The depicted torque adjustment assembly 440 includes a guide 450 that is fixedly disposed within the body 420. The head adaptor 442 is pivotally coupled to the guide 450 (e.g., with one or more pins or shafts). The first member 426 includes arms 427 that are disposed on either side of the guide 450 and is slidably coupled to the guide 450. The guide 450 includes an opening 452 that accepts a tab 454 of the body 420 to position the guide 450 within the body 420, and to maintain the guide 450 in the desired position.

As seen in FIG. 6, when the head 410 pivots out of alignment with the body 420, the cam 444 is configured to urge the first member 426 and the second member 428 along direction 408 (e.g., a radius of a lobe of the cam is greater at the point of the cam 444 that contacts the first member 426 when out of alignment than the radius of the lobe of the cam at the point of the cam 44 that contacts the first member 426 when in alignment), thereby compressing the spring 432 to increase the amount of torque applied to the head 410 before a click is provided, to compensate for pivoting of the head 110 for off-axis use. As best seen in FIG. 5, when the head 410 is brought into alignment with the body 420, the first member 426 and second member 428 are urged by the spring 432 to move along direction 406 (due to the reduction in radius of the lobe of the cam 444 when the head 410 is aligned with the body 420) to reduce compression of the spring 432.

Figure 7:
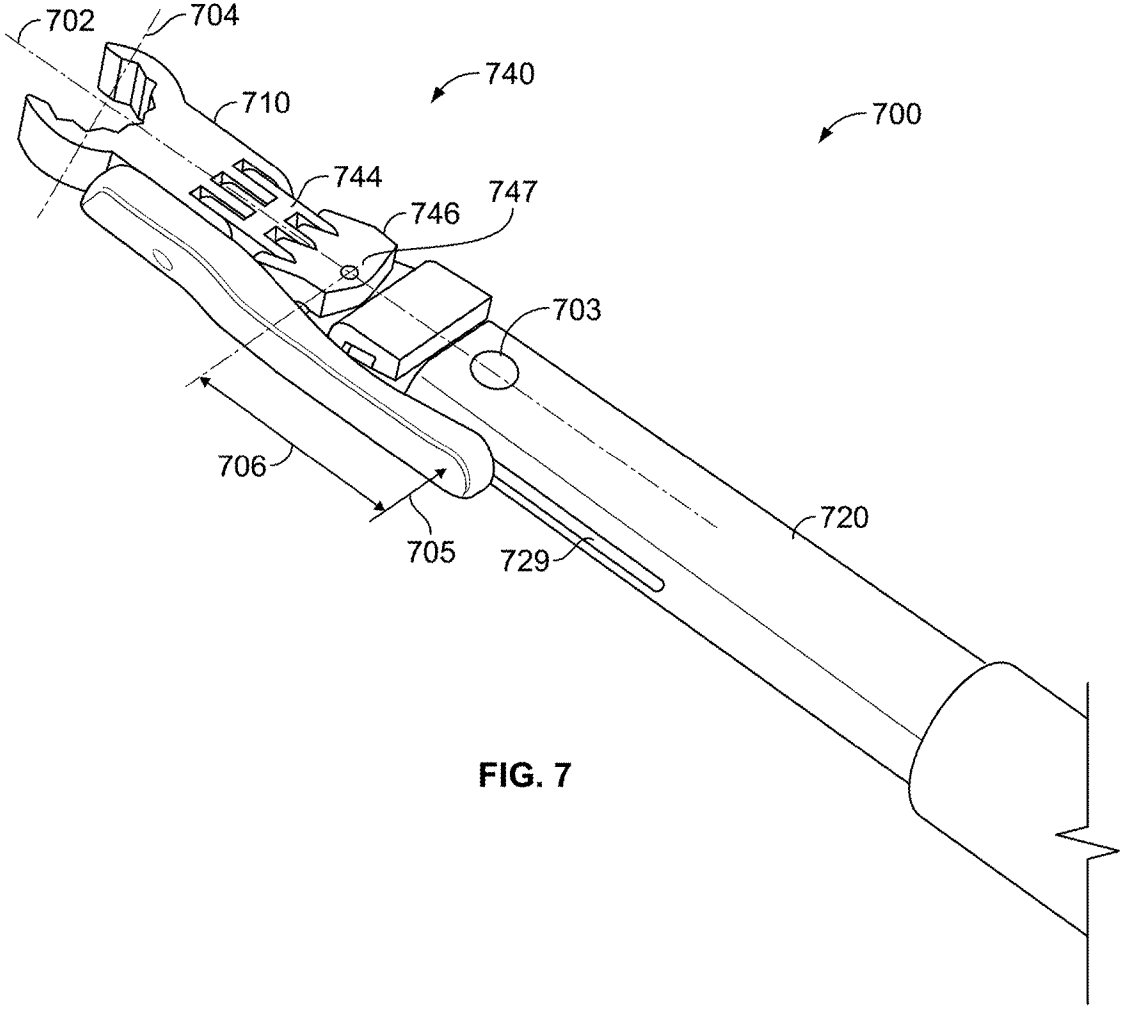
FIG. 7 illustrates a perspective view of a torque wrench formed in accordance with various embodiments.
Figure 8:
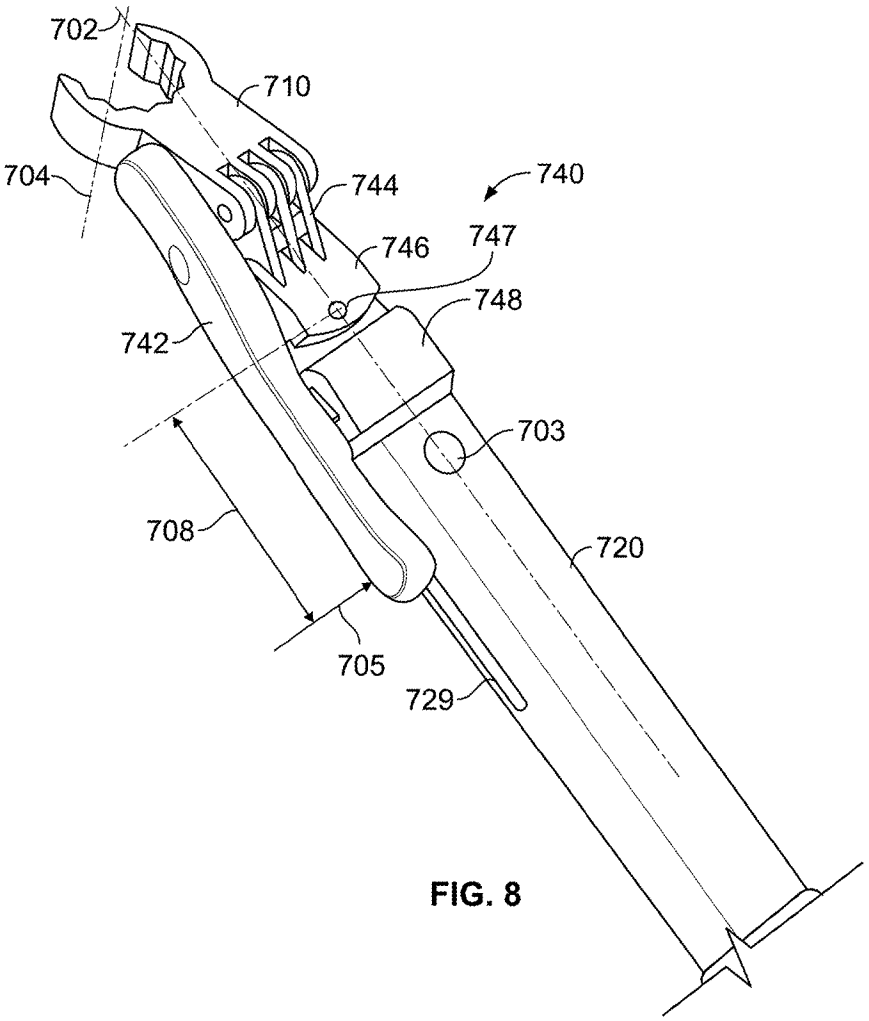
FIG. 8 provides an additional view of the torque wrench of FIG. 7.

As discussed above in connection with FIG. 1, in some embodiments the torque adjustment assembly 140 defines a pivot arm 134 transferring a force from the head 110 to the body 120, with a length of the pivot arm 134 varying relative to a pivoting of the head 110 relative to the body 420. FIG. 7 illustrates a torque wrench 700 in a position having a head aligned with a body, and FIG. 8 illustrates the torque wrench 700 in a position with the head not aligned with the body (e.g., for an off-axis use).

The depicted torque wrench 700 includes a head 710 coupled to a body 720 via a torque adjustment assembly 740. Force is transferred between the head 710 and the body 720 at contact point 705. As the head 710 pivots with respect to the body 720, the contact point 705 is moved (e.g., along the longitudinal axis 702) to change the amount of torque provided at the head 710 that will result in an indication of satisfaction of a predetermined amount of torque (e.g., provision of a click by a click-pivot mechanism disposed within the body 720). For example, the location of the contact point 705 with respect to an application point 747 may vary the amount of force applied by an operator that will cause the click-pivot mechanism to click. As seen in FIGS. 7-8, the distance 708 along the longitudinal axis 702 between the contact point 705 and the application point 747 when the head 710 is not aligned with the body 720 (see FIG. 8) is greater than the distance 706 along the longitudinal axis 702 between the contact point 705 and the application point 747 when the head 710 is aligned with the body 720 (see FIG. 7). As the perpendicular force at the application point 747 that makes the wrench click is constant, increasing the distance from the application point 747 to the contact point 705 forces a mechanic or operator to pull harder or apply more force to a wrench handle to make the wrench click when the wrench is used at off-axis angles. The distance 706, 708 between the contact point 705 and the application point 747 may be understood as corresponding to or describing a pivot arm (e.g., pivot arm 134) that varies as the angle between the longitudinal and torque axes varies.

The depicted torque adjustment assembly 740 includes a sliding arm 742 that defines a force application region (e.g., contact point 705) at which the force from the head 710 (e.g., a reactive force associated with turning a fastener) is transferred to the body 720. The sliding arm 742 is pivotally coupled to the head 710 and slidably coupled to the body 720. For example, a portion of the sliding arm 742 may be slidably accepted by a guide 729 of the body 720, and the sliding arm 742 may be coupled to the head 710 with a pin or shaft that allows the head 710 to pivot with respect to the sliding arm 742, so that the sliding arm 742 may articulate and/or slide along the longitudinal axis 702 and remain aligned with the longitudinal axis 702 as the head 710 pivots with respect to the body 720.

In the illustrated embodiment, the torque adjustment assembly also includes a first link 744 and a second link 746. In the illustrated embodiment, the second link 746 is mounted to an adaptor 748 that is in turn mounted to the click pivot mechanism of the body 720, for example via a dovetail joint. The second link 746 is mounted to the adaptor 748 via a pin defining the application point 747, at which point force is transferred to the sliding arm 742 (e.g., via a sliding connection). The head 710 is pivotally coupled to the first link 744. The first link 744 is interposed between the second link 746 and the head 710, and is also pivotally connected to the second link 746. For example, a first end of the first link 744 may be pivotally connected (e.g., by a pin or shaft) to the head 710, while a second end of the first link 744 (opposed to the first end) may be pivotally connected to the second link 746. The second link 746 is interposed between the first link 744 and the body 720. As the head 710 pivots with respect to the body 720, the first link 744 also pivots with respect to the body 720. However, the second link 746 is mounted to the body 720 such that it does not pivot when the first link 744 and head 710 pivot, resulting in a portion of the head 710 and the sliding arm 742 translating along the longitudinal axis 702 to increase the distance between the contact point 705 and the application point 747, thereby increasing the amount of force provided by the head 710 to the body 720 relative to the predetermined amount of torque required to activate a click mechanism (or, put another way, increasing the amount of force an operator or mechanic may apply to the wrench before activating the click mechanism).

Figure 9:
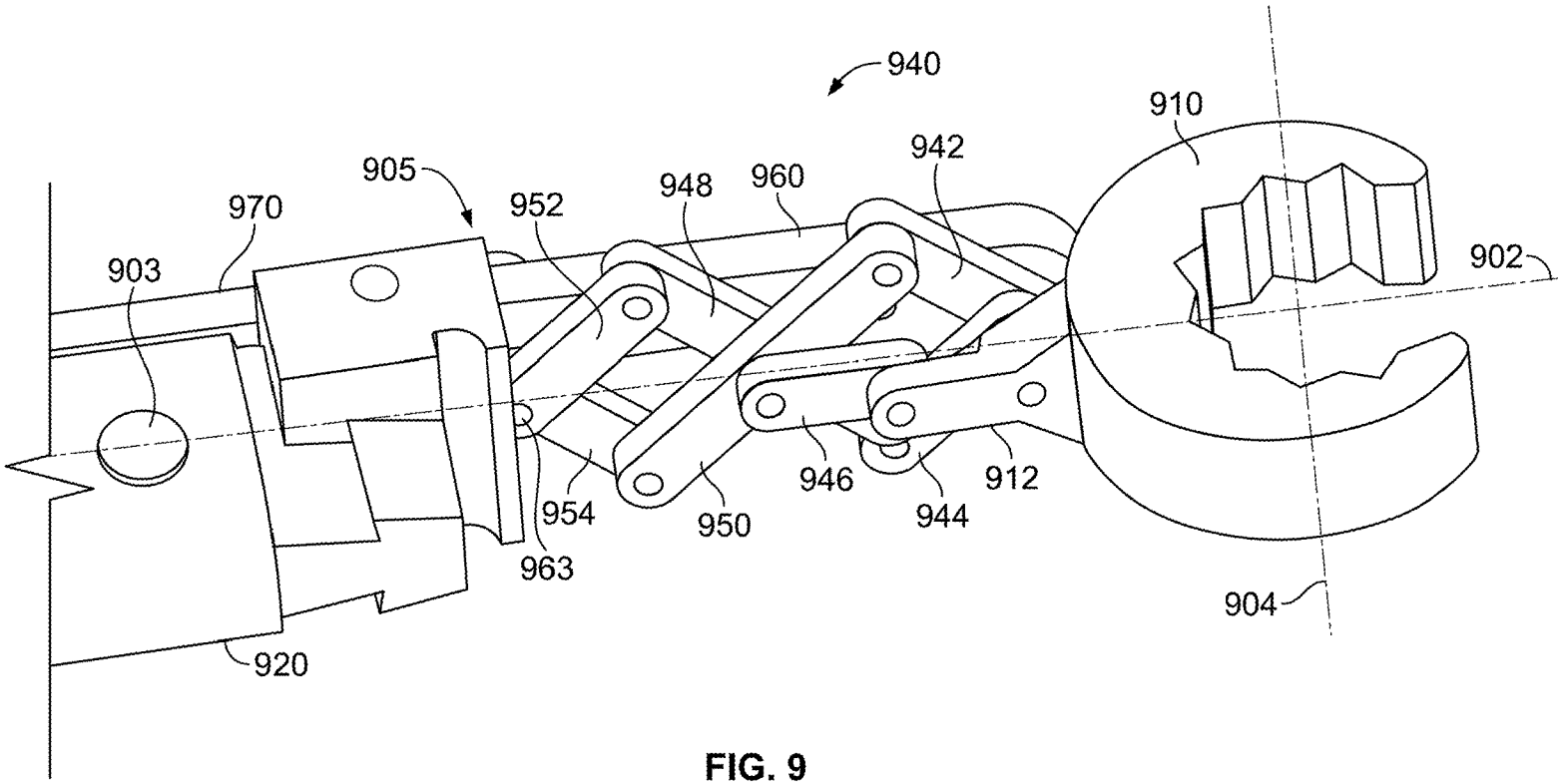
FIG. 9 illustrates a perspective view of a torque wrench formed in accordance with various embodiments.
Figure 10:
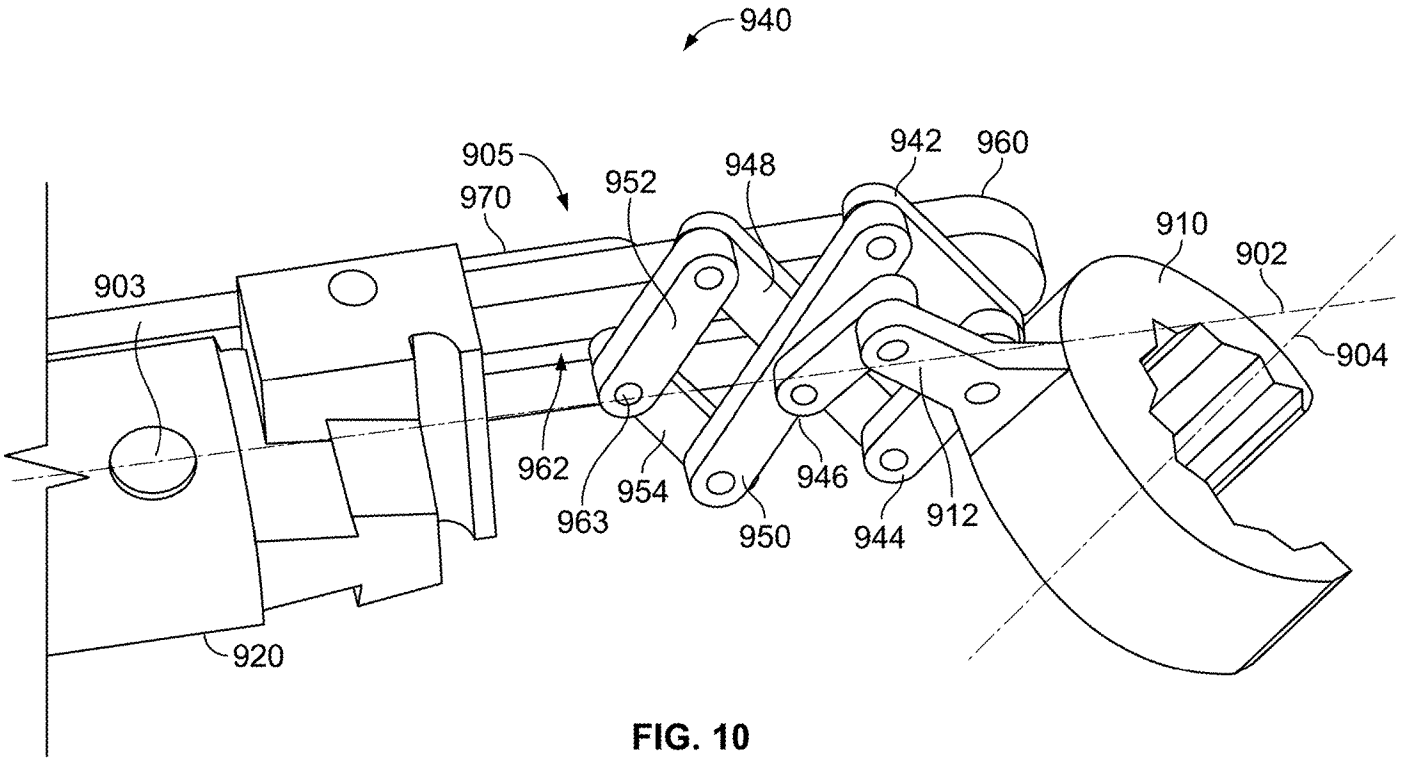
FIG. 10 provides an additional view of the torque wrench of FIG. 9.

Another example of a torque wrench for which a force application point or moment arm is varied responsive to a change of angle of the head with respect to the body is provided by FIGS. 9 and 10. FIG. 9 illustrates a torque wrench 900 in a position having a head aligned with a body, and FIG. 10 illustrates the torque wrench 900 in a position with the head not aligned with the body (e.g., for an off-axis use).

Figure 16:
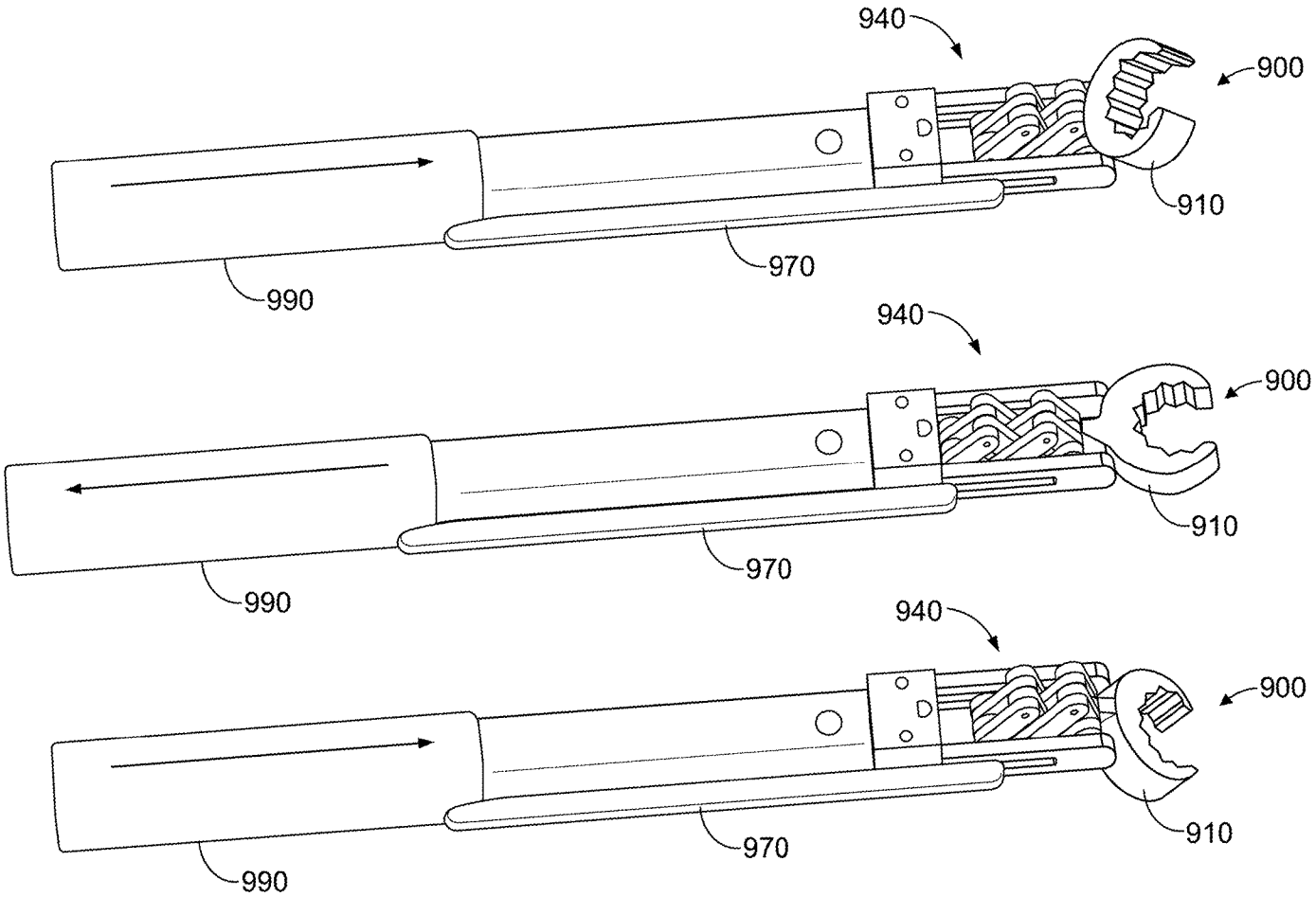
FIG. 16 provides views of the torque wrench of FIG. 9.

The depicted torque wrench 900 includes a head 910 coupled to a body 920 via a torque adjustment assembly 940. As seen in FIGS. 9 and 10, the depicted head 910 includes an extension 912, and the depicted torque adjustment assembly 940 includes a first link 942, a second link 944, a third link 946, a fourth link 948, a fifth link 950, a sixth link 952, a seventh link 954, a fixed arm 960, and a sliding arm 970. The sliding arm 970 is connected to a pin 963 that joins the sixth link 952 and the seventh link 954. An opposite end of the sliding arm 970 is connected to a sliding handle grip 990 (see FIG. 16, which depicts the torque wrench 900 with sliding handle 990 in various positions as the head 910 is pivoted) on the torque wrench 990. As the head 910 rotates off-axis, the sliding arm 970 slides toward the head 910, pulling the sliding handle grip 990 with it, and accordingly making the wrench effectively shorter. (As the sliding handle grip 990 is grasped by the operator and used to turn the wrench, the closer the sliding handle grip is drawn toward the head, the shorter the wrench effectively becomes). Reducing the distance from the sliding handle grip 990 to the click pivot point as the off-axis angle increases forces a mechanic or operator to pull harder or apply a greater force to activate the click mechanism with increasing off-axis angle. It may be noted that, while the shortening of the handle may tend to reduce the torque provided to the head, the torque adjustment assembly 940 is configured so that the increased force provided to the handle compensates for any reduction in torque due to reduced handle length.

Starting from the head end of the torque wrench 900, the first link 942 is pivotally connected to the head 910, and the second link 944 is pivotally connected to the head 910 along a common axis with the first link 942. For example, a single pin or shaft may be used to pivotally couple the first link 942 and the second link 944 with the head 910. The third link 946 is pivotally connected to the extension 912. The fourth link 948 is pivotally connected to the second link 944 and the third link 946, and the fifth link 950 is pivotally connected to the first link 942 and the third link 946. For example, the fourth link 948 and the fifth link 950 may be pivotally connected to an end of the third link 946 that is opposite an end of the third link 946 pivotally coupled to the extension 912. The third link 946 may be pivotally coupled with a single pin or shaft to respective central portions of the fourth link 948 and the fifth link 950. The sixth link 952 is pivotally connected to the fifth link 950, and the seventh link 954 is pivotally connected to the fourth link 948 and the sixth link 952.

The fixed arm 960 couples the head 910 to the body 920, with the head 910 pivotally connected to the fixed arm 960 (e.g., via a shaft or pin coupling the first link 942 and the second link 944 to the head 910). The fixed arm 960 includes a guide 962 that extends along the longitudinal axis 902. For example, the guide 962 may be configured as a slot that accepts a pin or shaft 963 that pivotally couples the sixth link 952 and the seventh link 954. The sliding arm 970 is coupled to the sixth link 952 and the seventh link 954 (e.g., with the pin or shaft 963 that pivotally couples the sixth link 952 and the seventh link 954), and is slidably connected to the fixed arm 960 via the guide 962. For example, the pin or shaft 963 that couples the sixth link 952 and the seventh link 954 may extend through the slot 962 to the sliding arm 970. The end of the linkage at which the sixth link 952 and seventh link 954 are joined may define a contact point 905 of force transfer between the head 910 and the sliding arm 970. The contact point 905 and the sliding arm 970 in the illustrated embodiment articulate along the longitudinal axis 902 responsive to a pivoting of the head 910 relative to the body 920.

As seen in FIGS. 9 and 10, as the head 910 pivots, away from the longitudinal axis 902 (e.g., with the torque axis 904 moving away from perpendicular to the longitudinal axis 902), with respect to the body 920, the links cooperate to draw the contact point 905 (defined by connection between the sixth link 952 and the seventh link 954 with the fixed arm 960) and the sliding arm 970 toward the head, thereby drawing the sliding grip handle 990 of the sliding arm 970 toward the head 910. For example, the pivoting of the head 910, may, via the connection between the extension 912 and the third link 946, draw the third link 946 away from the body, thereby urging central portions of the fourth link 948 and fifth link 950 away from the body 920 and urging the contact point 905 away from the body 920.

Figure 11B:
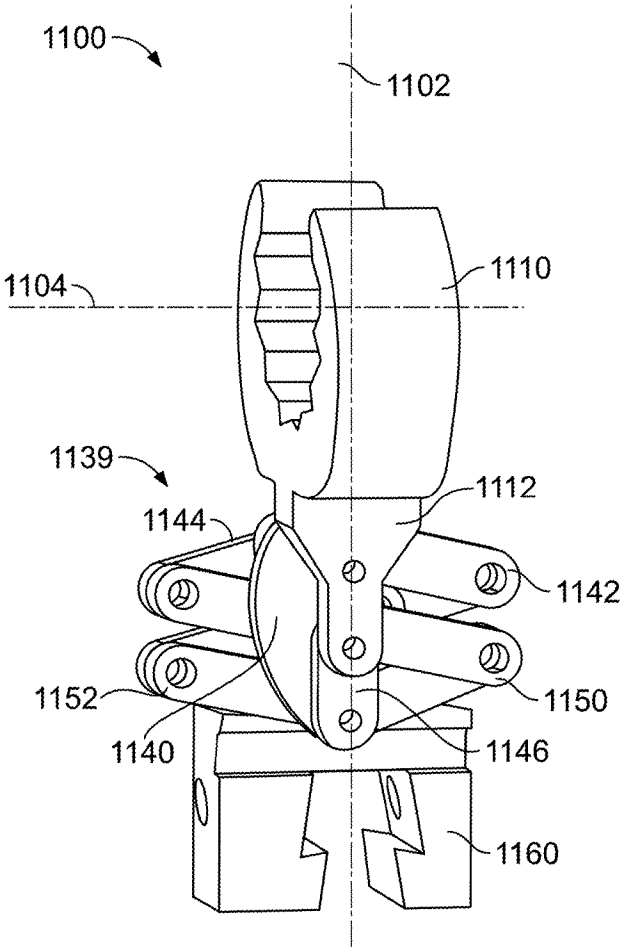
FIG. 11B illustrates a rear perspective view of a torque wrench formed in accordance with various embodiments FIG. 12A provides an additional front perspective view of the torque wrench of FIG. 1.
Figure 11A:
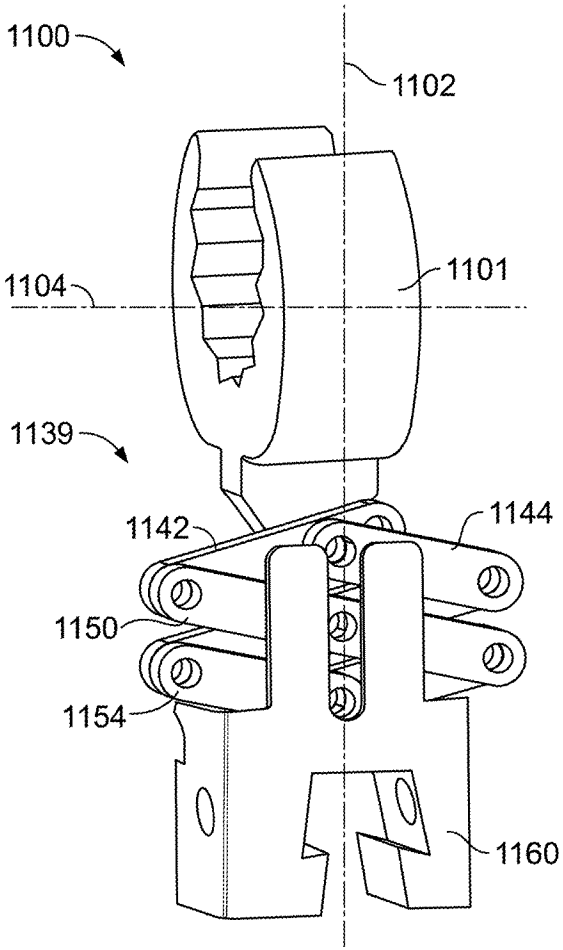
FIG. 11A illustrates a front perspective view of a torque wrench formed in accordance with various embodiments.
Figure 12B:
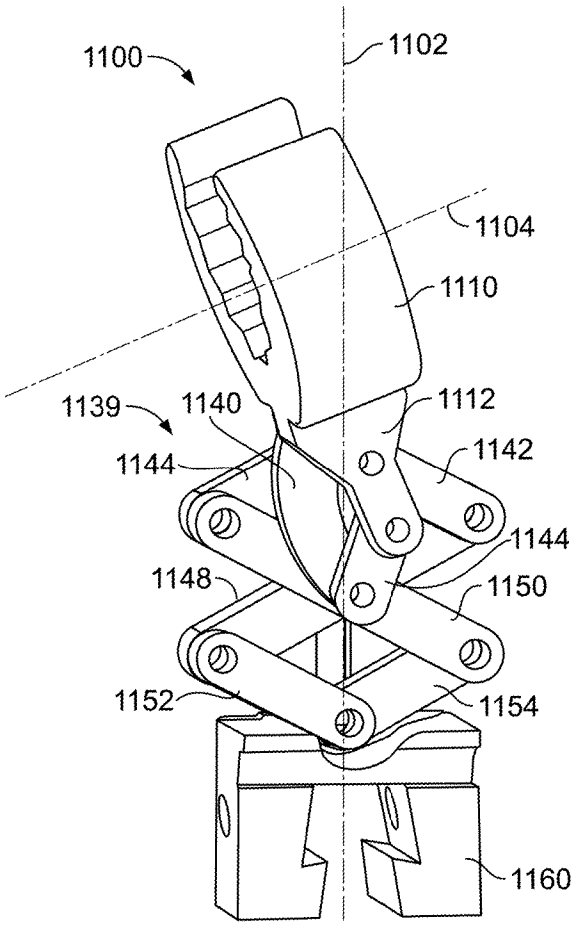
FIG. 12B provides an additional rear perspective view of the torque wrench of FIG. 1.
Figure 12A:
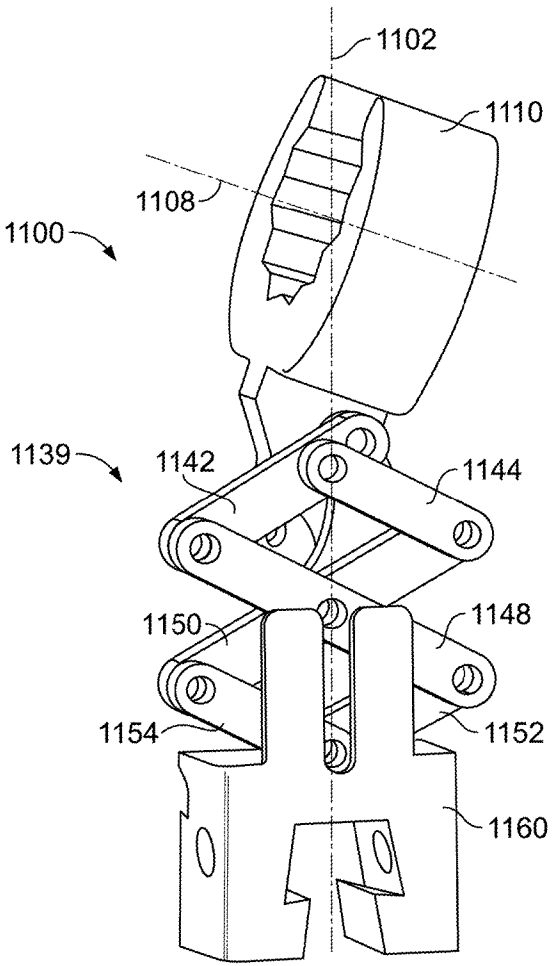

As discussed herein, in various embodiments, the torque adjustment assembly 140 is configured to vary a distance of the torque axis 104 from the body 120 when the head 110 pivots relative to the body 120. For example, the torque adjustment assembly 140 may include plural links pivotally coupled and configured to extend the head 110 away from the body 120 responsive to a pivoting of the torque axis 104 away from a perpendicular alignment with the longitudinal axis 102, or to extend an application point of force from the head 110 away from the body 120 responsive to such a change. An example of such a torque wrench is provided by FIGS. 11A, 11B, 12A, and 12B. FIGS. 11A and 11B illustrate a torque wrench 1100 in a position having a head aligned with a body, and FIGS. 12A and 12B illustrates the torque wrench 1100 in a position with the head not aligned with the body (e.g., for an off-axis use). It may be noted that, for the embodiment depicted in FIGS. 11 and 12, the force required to be provided on the handle by the operator to activate the click mechanism does not change for off-axis angles. Instead, the length from the head of the wrench to the body increases, thereby providing increased torque at the head for the same force applied at the handle.

In the illustrated embodiment, the torque wrench 1100 includes a head 1110 coupled to a body (not shown in FIGS. 11 and 12) via a torque adjustment assembly 1139. The torque adjustment assembly 1140 includes an adaptor 1160 configured to join the torque adjustment assembly 1140 to the body, for example via a dovetail joint. Force is transferred between the head 1110 and the body with a moment arm defined by or corresponding to a distance from the head 1110 to the body. As the head 110 pivots with respect to the body, the distance of the head 1110 from the body (e.g., along the longitudinal axis 1102) is varied to change the amount of torque provided at the head 1110 that will result in an indication of satisfaction of a predetermined amount of torque (e.g., provision of a click by a click-pivot mechanism disposed within the body). In the illustrated embodiment, as the head 1110 pivots further out of alignment with the body (or as the torque axis 1104 pivots further away from a perpendicular alignment with respect to the longitudinal axis 1102), the head 1110 is extended away from the body, providing more force or torque to the head 1110 for the same input force to the handle.

As shown in FIGS. 11A, 11B, 12A, and 12B, the depicted torque adjustment assembly 1139 includes a first link 1140, a second link 1142, a third link 1144, a fourth link 1146, a fifth link 1148, a sixth link 1150, a seventh link 1152, and an eighth link 1154. Starting from the head end of the torque wrench 1100, the first link 1140 is pivotally connected to the head 1110. The second link 1142 is pivotally connected to the head 1110 and the first link 1141 along a common axis (e.g., by a shared pin or shaft). The third link 1144 is pivotally connected to the second link 1142, and the fourth link 1146 is pivotally connected to the first link 1140 and the extension 1112. The fifth link 1148 is pivotally connected to the second link 1142, the first link 1140, and the fourth link 1146. For example, a first end of the fifth link 1148 may be coupled to the second link 1142, and a central portion of the fifth link 1148 may be coupled to an end of the first link 1140 and an end of the fourth link 1146. Similarly, the sixth link 1150 is pivotally connected to the third link 1144, the first link 1140, and the fourth link 1146. The seventh link 1152 is pivotally connected to the fifth link 1148, and the eighth link 1154 is pivotally connected to the seventh link 1152 and the sixth link 1150. The seventh link 1152 and the eighth link 1154 may be pinned or joined by a shaft to the adaptor 1160, which is in turn joined to the body.

As the head 1110 is pivoted, the links cooperate to move the head 1110 away from the body. For example, the first link 1140 and the fourth link 1146 may cooperate to extend a central portion of the fifth link 1148 and the sixth link 1150 away from the body, or straightening a bellows-type structure formed by the links to extend the head 1110 away from the body.

Figure 13:
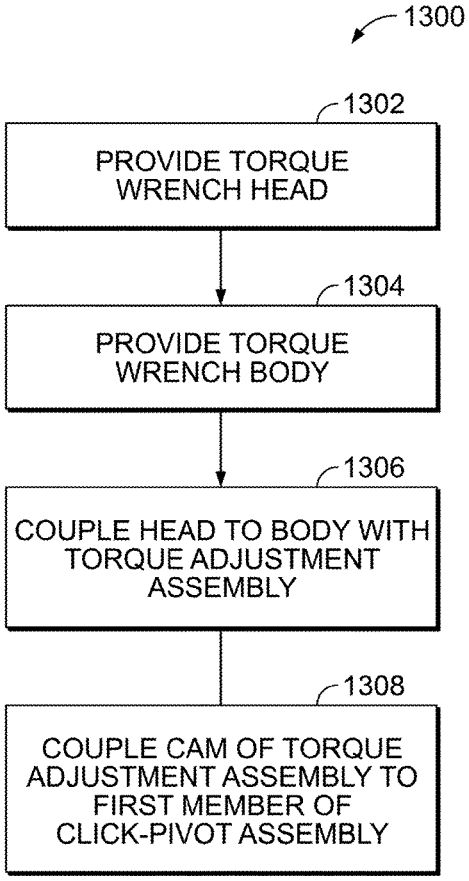
FIG. 13 provides a flowchart of a method according to an embodiment of the present disclosure.

FIG. 13 provides a flowchart of a method 1300 (e.g., for providing a torque wrench), in accordance with various embodiments. The method 1300, for example, may employ or be performed by structures or aspects of various embodiments (e.g., systems and/or methods and/or process flows) discussed herein. In various embodiments, certain steps may be omitted or added, certain steps may be combined, certain steps may be performed concurrently, certain steps may be split into multiple steps, certain steps may be performed in a different order, or certain steps or series of steps may be re-performed in an iterative fashion.

At 1302, a torque wrench head is provided. The head is shaped and adapted to engage at least one of a fastener or a torque-application adaptor aligned with a torque axis. The torque axis may be normal to a plane defined by the head. The torque wrench head may be configured for use with a torque wrench that includes a body extending along a longitudinal axis, with the head pivotal with respect to the body for off-axis use (e.g., to tighten a fastener defining a torque axis that is not perpendicular to the longitudinal axis of the torque wrench).

At 1304, a body for the torque wrench is provided. The body includes a handle and a click-pivot assembly. The click-pivot assembly in various embodiments includes first and second member coupled by a link. The click-pivot-assembly is configured to indicate application of a predetermined amount of torque via the handle.

At 1306, the head is coupled to the body with a torque adjustment assembly. The head is pivotally coupled to the body via the torque adjustment assembly. A change in angle between the torque axis and the longitudinal axis dynamically adjusts an amount of torque provided by a the head by a predetermined amount relative to the predetermined amount of torque permitted by the click-pivot assembly that is applied via the handle.

In some embodiments, the click-pivot assembly may include a spring disposed within the body. The spring may be configured to bias the second member of the click-pivot assembly toward the first member of the click-pivot assembly, with the predetermined amount of torque applied via the handle (e.g., the force permitted before actuation of a click-pivot assembly) determined by a force applied by the spring. The torque adjustment assembly may be configured to vary a compression of the spring responsive to the pivoting of the head relative to the body. For such an example, in various embodiments, at 1308, coupling the head to the body includes coupling a cam of the torque adjustment assembly to the first member of the click-pivot assembly, with the cam configured to articulate the first member along the longitudinal axis when the head pivots relative to the body.

Figure 17:
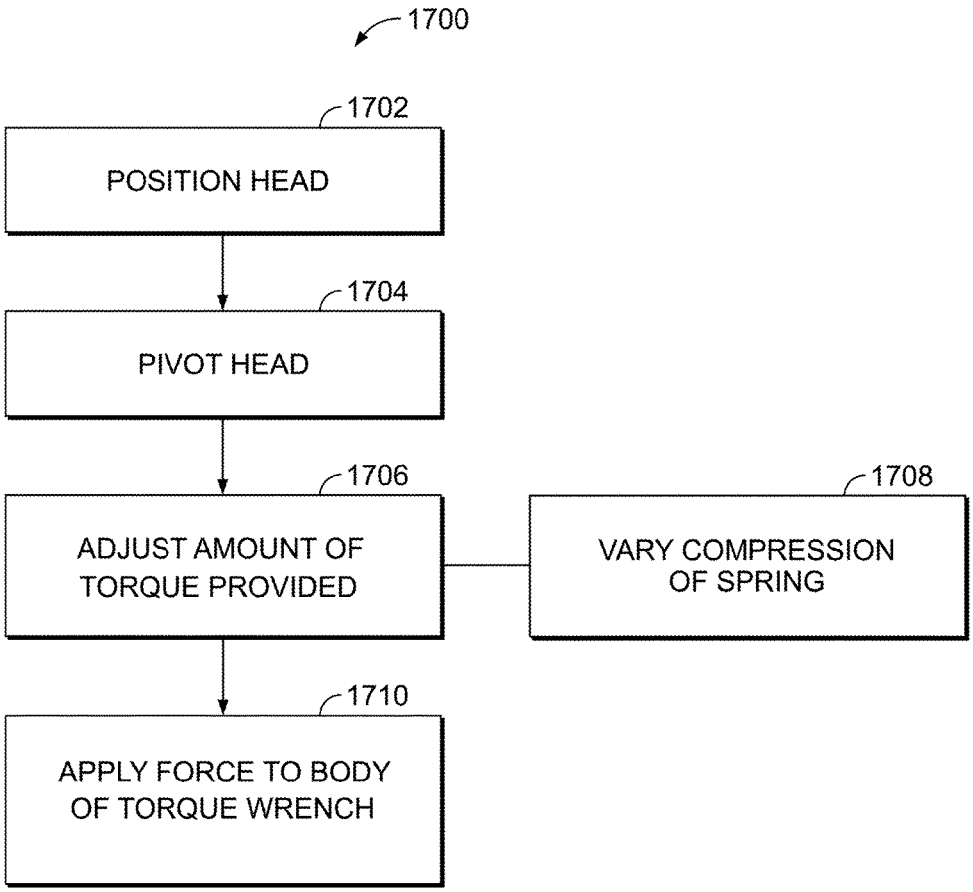
FIG. 17 provides a flowchart of a method according to an embodiment of the present disclosure.

FIG. 17 provides a flowchart of a method 1700 (e.g., for applying a torque to a fastener), in accordance with various embodiments. The method 1700, for example, may employ or be performed by structures or aspects of various embodiments (e.g., systems and/or methods and/or process flows) discussed herein. In various embodiments, certain steps may be omitted or added, certain steps may be combined, certain steps may be performed concurrently, certain steps may be split into multiple steps, certain steps may be performed in a different order, or certain steps or series of steps may be re-performed in an iterative fashion.

At 1702, a head of the torque wrench is positioned. The head of the torque wrench may be positioned to engage at least one of a fastener or a torque-application adpator aligned with a torque axis. For example, an opening of the head of the torque wrench may be positioned to accept the head of a fastener such as a capscrew, or to accept a nut threaded on to a bolt.

At 1704, the head of the torque wrench is pivoted. For example, the head of the torque wrench may be pivoted for an off-axis use for which the torque axis is not perpendicular to the longitudinal axis of the torque wrench.

At 1706, an amount of torque provided by the head relative to an applied force on a handle of the torque wrench is adjusted. For example, as the head pivots, a torque adjustment assembly that couples the head to a body of the torque wrench may be used to adjust an amount of torque provided by the head by a predetermined amount relative to an amount of torque indicated by a click-pivot assembly of the torque wrench. A change in an angle between the torque axis and the longitudinal axis dynamically adjusts the amount of torque provided by the head. For example, the amount of torque provided by the head relative to an input force to the handle may increase as the angle between the torque axis and the longitudinal axis increasingly deviates from perpendicular.

It may be noted that, in some embodiments, the click-pivot assembly may include a spring disposed within the body, with the spring biasing a second member of the click-pivot assembly toward a first member of the click-pivot assembly, and the amount of torque indicated by the click-pivot assembly determined by a force applied by the spring. For example, for such an embodiment, at 1708, adjusting the amount of torque may include varying a compression of the spring responsive to the pivoting of the head relative to the body.

At 1710, a force is applied to the body of the torque wrench. The force may be use to apply a torque to the at least one of the fastener or the torque-application adaptor. For example, a force may be applied by an operator to a handle of the torque wrench to tighten a fastener to a predetermined torque level.

Figure 14:
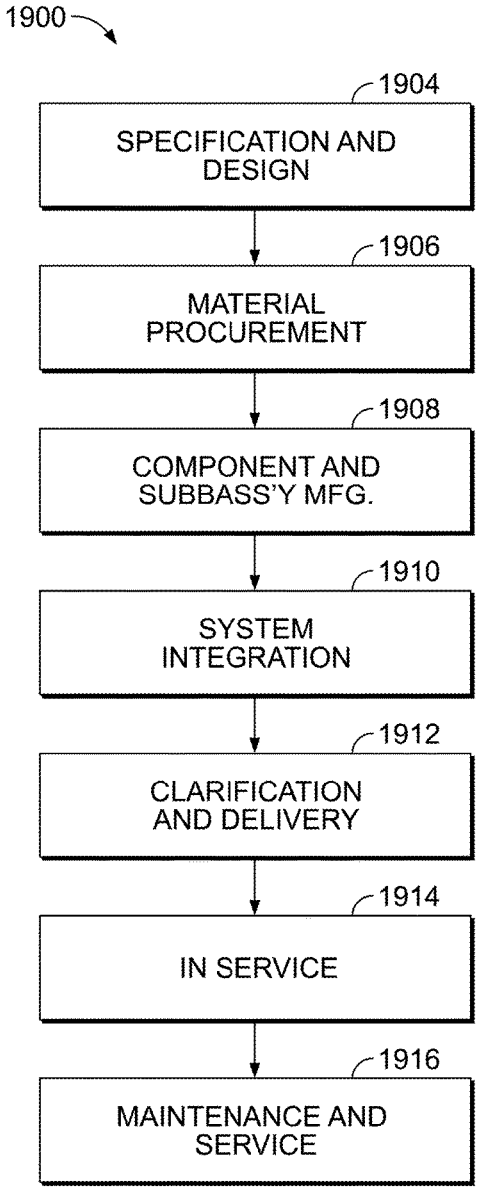
FIG. 14 is a block diagram of aircraft production and service methodology.
Figure 15:
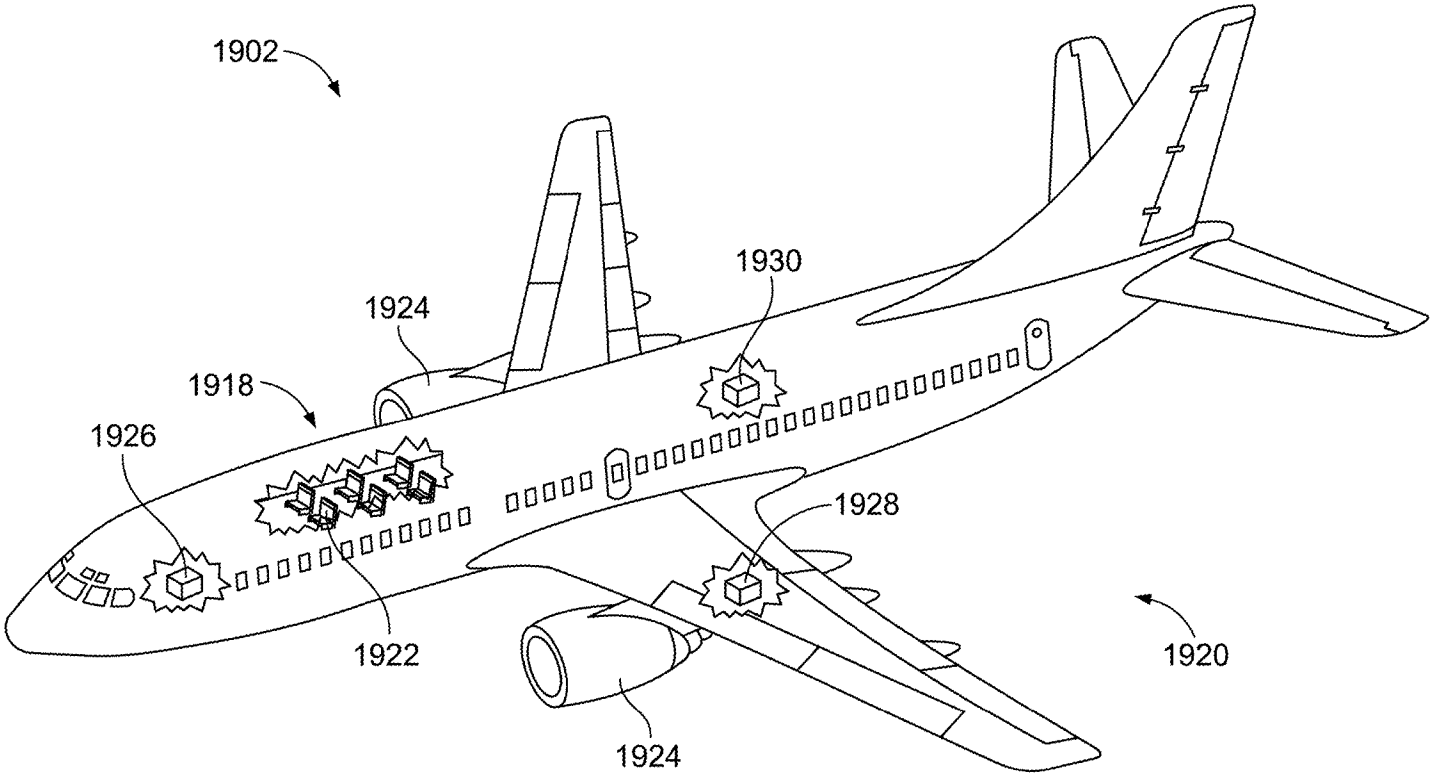
FIG. 15 is a schematic illustration of an aircraft.

Examples of the present disclosure may be described in the context of aircraft manufacturing and service method 1900 as shown in FIG. 14 and aircraft 1902 as shown in FIG. 15. During pre-production, illustrative method 1900 may include specification and design (block 1904) of aircraft 1902 and material procurement (block 1906). During production, component and subassembly manufacturing (block 1908) and system integration (block 1910) of aircraft 1902 may take place. Thereafter, aircraft 1902 may go through certification and delivery (block 1912) to be placed in service (block 1914). While in service, aircraft 1902 may be scheduled for routine maintenance and service (block 1916). Routine maintenance and service may include modification, reconfiguration, refurbishment, etc. of one or more systems of aircraft 1902. For example, in various embodiments, examples of the present disclosure may be used in conjunction with one or more of blocks 1908, 1910, or 1916.

Each of the processes of illustrative method 1900 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 15, aircraft 1902 produced by illustrative method 1900 may include airframe 1918 with a plurality of high-level systems 1920 and interior 1922. Examples of high-level systems 1920 include one or more of propulsion system 1924, electrical system 1926, hydraulic system 1928, and environmental system 1930. Any number of other systems may be included. Although an aerospace example is shown, the principles disclosed herein may be applied to other industries, such as the automotive industry. Accordingly, in addition to aircraft 1902, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1900. For example, components or subassemblies corresponding to component and subassembly manufacturing 1908 may be fabricated or manufactured in a manner similar to components or subassemblies produced while aircraft 1902 is in service. Also, one or more examples of the apparatus(es), method(s), or combination thereof may be utilized during production stages 1908 and 1910, for example, by substantially expediting assembly of or reducing the cost of aircraft 1902. Similarly, one or more examples of the apparatus or method realizations, or a combination thereof, may be utilized, for example and without limitation, while aircraft 1902 is in service, e.g., maintenance and service stage (block 1916).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A torque wrench extending along a longitudinal axis and comprising:

a head shaped and adapted to engage at least one of a fastener or a torque-application adaptor aligned with a torque axis, the head defining a plane oriented normal to the torque axis;

a body comprising a handle and a click-pivot assembly, the click-pivot assembly comprising first and second members coupled by a link, the click-pivot assembly configured to indicate application of a predetermined amount of torque via the handle, wherein the body extends along the longitudinal axis and the head is pivotable with respect to the body such that an angle between the torque axis and the longitudinal axis is variable; and a torque adjustment assembly, the head pivotally coupled to the body via the torque adjustment assembly, the torque adjustment assembly comprising at least one of a cam, an arrangement of links, or a guide that provides an assembly geometry that provides a consistent amount of torque to the head from the body when the head is pivoted with respect to the body such that the angle between the torque axis and the longitudinal axis varies, wherein the torque adjustment assembly is configured to vary a distance of the entire head from the body when the head pivots relative to the body such that the angle between the torque axis and the longitudinal axis varies, wherein a change in an angle between the torque axis and the longitudinal axis dynamically adjusts an amount of torque provided by the head by a predetermined amount relative to the predetermined amount of torque applied via the handle.

2. The torque wrench of claim 1, wherein the amount of torque provided by the head relative to the predetermined amount applied via the handle increases as the angle between the torque axis and the longitudinal axis increasingly diverges from perpendicular.

3. The torque wrench of claim 1, wherein the torque adjustment assembly is configured to articulate at least a portion of the click-pivot assembly disposed within the body along the longitudinal axis responsive to a pivoting of the head relative to the body.

4. The torque wrench of claim 1, wherein the torque adjustment assembly comprises plural links pivotally coupled and configured to extend the head away from the body responsive to responsive to a pivoting of the torque axis away from a perpendicular alignment with the longitudinal axis.

5. A torque wrench extending along a longitudinal axis and comprising:

a head shaped and adapted to engage at least one of a fastener or a torque-application adaptor aligned with a torque axis, the head defining a plane oriented normal to the torque axis, wherein the head comprises an extension;

a body comprising a handle and a click-pivot assembly, the click-pivot assembly comprising first and second members coupled by a link, the click-pivot assembly configured to indicate application of a predetermined amount of torque via the handle, wherein the body extends along the longitudinal axis and the head is pivotable with respect to the body such that an angle between the torque axis and the longitudinal axis is variable; and a torque adjustment assembly, the head pivotally coupled to the body via the torque adjustment assembly, the torque adjustment assembly comprising at least one of a cam, an arrangement of links, or a guide that provides an assembly geometry that provides a consistent amount of torque to the head from the body when the head is pivoted with respect to the body such that the angle between the torque axis and the longitudinal axis varies, wherein a change in an angle between the torque axis and the longitudinal axis dynamically adjusts an amount of torque provided by the head by a predetermined amount relative to the predetermined amount of torque applied via the handle, wherein the torque adjustment assembly comprises:

a first link pivotally connected to the head;

a second link pivotally connected to the head and first link along a common axis;

a third link pivotally connected to the second link;

a fourth link pivotally connected to the first link and the extension;

a fifth link pivotally connected to the second link, the first link, and the fourth link;

a sixth link pivotally connected to the third link, the first link, and the fourth link;

a seventh link pivotally connected to the fifth link; and an eighth link pivotally connected to the sixth link and the seventh link.

6. A torque wrench extending along a longitudinal axis and comprising:

a head shaped and adapted to engage at least one of a fastener or a torque-application adaptor aligned with a torque axis, the head defining a plane oriented normal to the torque axis;

a body comprising a handle and a click-pivot assembly, the click-pivot assembly comprising first and second members coupled by a link, the click-pivot assembly configured to indicate application of a predetermined amount of torque via the handle, wherein the body extends along the longitudinal axis and the head is pivotable with respect to the body such that an angle between the torque axis and the longitudinal axis is variable; and a torque adjustment assembly, the head pivotally coupled to the body via the torque adjustment assembly, the torque adjustment assembly comprising at least one of a cam, an arrangement of links, or a guide that provides an assembly geometry that provides a consistent amount of torque to the head from the body when the head is pivoted with respect to the body such that the angle between the torque axis and the longitudinal axis varies, wherein a change in an angle between the torque axis and the longitudinal axis dynamically adjusts an amount of torque provided by the head by a predetermined amount relative to the predetermined amount of torque applied via the handle, wherein the torque adjustment assembly comprises:

a first link pivotally connected to the head;

a second link pivotally connected to the head and first link along a common axis;

a third link pivotally connected to the extension;

a fourth link pivotally connected to the second link and the third link;

a fifth link pivotally connected to the first link and the third link;

a sixth link pivotally connected to the fifth link;

a seventh link pivotally connected to the fourth link and the sixth link;

a fixed arm coupling the head to the body, the head pivotally connected to the fixed arm, the fixed arm comprising a guide extending parallel to the longitudinal axis; and a sliding arm coupled to the sixth link and the seventh link, the sliding arm slidably connected to the fixed arm via the guide, wherein the sliding arm articulates along the longitudinal axis responsive to a pivoting of the head relative to the body.

7. A torque wrench extending along a longitudinal axis and comprising:

a head shaped and adapted to engage at least one of a fastener or a torque-application adaptor aligned with a torque axis, the head defining a plane oriented normal to the torque axis;

a body comprising a handle and a click-pivot assembly, the click-pivot assembly comprising a spring and first and second members, the first member and second member coupled by a link, the second member interposed between the spring and the first member, the spring configured to bias the second member toward the first member, wherein a force applied by the spring determines a predetermined amount of torque applied by the handle indicated by the click-pivot assembly, wherein the body extends along the longitudinal axis and the head is pivotable with respect to the body such that an angle between the torque axis and the longitudinal axis is variable; and a torque adjustment assembly, the head pivotally coupled to the body via the torque adjustment assembly, wherein an increase in a deviation from a perpendicular orientation between the torque axis and the longitudinal axis compresses the spring to dynamically adjust an amount of torque provided by the head by a predetermined amount relative to the predetermined amount of torque applied via the handle.

8. The torque wrench of claim 7, wherein the torque adjustment assembly includes a head adaptor including a cam, the cam coupled to the first member of the click-pivot assembly and configured to articulate the first member along the longitudinal axis when the head pivots relative to the body.

9. The torque wrench of claim 8, wherein the torque adjustment assembly includes a guide fixedly disposed within the body, the head adaptor pivotally coupled to the guide, the first member comprising arms disposed on either side of the guide, the first member slidably coupled to the guide.

10. The torque wrench of claim 9, wherein the guide of the torque adjustment assembly includes an opening configured to accept a tab of the body to position the guide within the body.

11. A method for using a torque wrench, the torque wrench defining a longitudinal axis, the method comprising;

positioning a head to engage at least one of a fastener or a torque-application adaptor aligned with a torque axis, the head defining a plane oriented normal to the torque axis;

pivoting the head with respect to the longitudinal axis such that an angle between the torque axis and the longitudinal axis varies;

adjusting, as the head pivots, with a torque adjustment assembly that couples the head to a body that extends along the longitudinal axis of the torque wrench, an amount of torque provided by the head by a predetermined amount relative to an amount of torque indicated by a click-pivot assembly of the torque wrench, wherein a change in an angle between the torque axis and the longitudinal axis dynamically adjusts the amount of torque provided by the head, wherein a consistent amount of torque is provided to the head from the body when the head is pivoted with respect to the body such that the angle between the torque axis and the longitudinal axis varies, wherein the torque adjustment assembly varies a distance from the entire head from the body when the head pivots relative to the body such that the angle between the torque axis and the longitudinal axis varies; and applying a force to the body of the torque wrench to apply a torque to the at least one of the fastener or the torque-application adaptor.

12. The method of claim 11, wherein the click-pivot assembly comprises a spring disposed within the body, the spring biasing a second member of the click-pivot assembly toward a first member of the click-pivot assembly, the amount of torque indicated by the click-pivot assembly determined by a force applied by the spring, wherein adjusting the amount of torque comprises varying a compression of the spring responsive to the pivoting of the head relative to the body.

13. The method of claim 11, wherein the amount of torque provided by the head relative to the amount indicated by the click-pivot assembly increases as the angle between the torque axis and the longitudinal axis increasingly diverges from perpendicular.

14. The method of claim 11, wherein the torque adjustment assembly is configured to articulate at least a portion of the click-pivot assembly disposed within the body along the longitudinal axis responsive to a pivoting of the head relative to the body.

15. A torque wrench extending along a longitudinal axis and comprising:

a head shaped and adapted to engage at least one of a fastener or a torque-application adaptor aligned with a torque axis, the head defining a plane oriented normal to the torque axis;

a body comprising a handle and torque-indication means for indicating application of a predetermined amount of torque via the handle, the handle comprising a sliding grip, wherein the body extends along the longitudinal axis and the head is pivotable with respect to the body such that an angle between the torque axis and the longitudinal axis is variable; and a torque adjustment assembly configured to adjust an amount of torque provided by the head by a predetermined amount relative to the predetermined amount of torque applied via the handle, wherein the head is pivotally coupled to the body via at least a portion of the torque adjustment assembly, wherein a consistent amount of torque is provided to the head from the body when the head is pivoted with respect to the body such that the angle between the torque axis and the longitudinal axis varies, wherein the torque adjustment assembly comprises a sliding arm that extends alongside an exterior of the body and is slidably coupled to the body, the sliding arm coupled to the sliding grip of the handle, the sliding arm defining a three application region at a contact point at which force is transferred from the head to the body, wherein a length of a pivot arm defined by the sliding arm varies relative to a pivoting of the head relative to the body.

* * * * *